US009770931B2

(12) United States Patent
Zhou et al.

(10) Patent No.: US 9,770,931 B2
(45) Date of Patent: Sep. 26, 2017

(54) FABRIC PRINT MEDIUM

(71) Applicant: Hewlett-Packard Development Company, L.P., Fort Collins, CO (US)

(72) Inventors: Xiaoqi Zhou, San Diego, CA (US); Paul C. Landrum, San Diego, CA (US); Ana Belen de la Rosa Gimenez, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 203 days.

(21) Appl. No.: 14/784,758

(22) PCT Filed: Jun. 6, 2013

(86) PCT No.: PCT/US2013/044460
§ 371 (c)(1),
(2) Date: Oct. 15, 2015

(87) PCT Pub. No.: WO2014/196974
PCT Pub. Date: Dec. 11, 2014

(65) Prior Publication Data

US 2016/0059606 A1 Mar. 3, 2016

(51) Int. Cl.

| | |
|---|---|
| ***B41M 5/52*** | (2006.01) |
| ***B41M 5/50*** | (2006.01) |
| ***D03D 1/00*** | (2006.01) |
| ***D06M 15/71*** | (2006.01) |
| ***D06P 5/30*** | (2006.01) |
| ***D06P 1/44*** | (2006.01) |

(52) U.S. Cl.
CPC ..... *B41M 5/52* (2013.01); *B41M 5/508* (2013.01); *B41M 5/5218* (2013.01); *B41M 5/5254* (2013.01); *B41M 5/5281* (2013.01); *D03D 1/00* (2013.01); *D06M 15/71* (2013.01); *D06P 1/44* (2013.01); *D06P 5/30* (2013.01); *B41M 5/5227* (2013.01); *B41M 5/5236* (2013.01)

(58) Field of Classification Search
CPC ..... B41M 5/52; B41M 5/508; B41M 5/5218; B41M 5/5254; B41M 5/5281; B41M 5/5227
See application file for complete search history.

(56) References Cited

U.S. PATENT DOCUMENTS

| | | | |
|---|---|---|---|
| 6,001,137 | A | 12/1999 | Alfekri et al. |
| 6,326,323 | B1 | 12/2001 | Shimano et al. |
| 6,478,980 | B2 | 11/2002 | Nigam |

(Continued)

FOREIGN PATENT DOCUMENTS

| | | |
|---|---|---|
| EP | 2233634 | 9/2010 |
| JP | 2000303361 | 10/2000 |

(Continued)

*Primary Examiner* — Betelhem Shewareged
(74) *Attorney, Agent, or Firm* — HP Inc. Patent Department

(57) ABSTRACT

A fabric print medium containing a fabric base substrate and a primer layer composition applied to the fabric base substrate. Said primer layer composition includes at least three types of polymeric particles, at least two different fire retardant agents and a water-soluble high-valence metal complex. Also disclosed are the method for making such fabric print medium and the method for producing printed images using said material.

15 Claims, 1 Drawing Sheet

(56) References Cited

U.S. PATENT DOCUMENTS

| | | | | |
|---|---|---|---|---|
| 6,589,633 | B1 | 7/2003 | Ino et al. | |
| 6,838,132 | B1 * | 1/2005 | Iguchi | B41M 5/508 428/32.16 |
| 6,939,583 | B2 | 9/2005 | Katsuki et al. | |
| 7,592,054 | B2 * | 9/2009 | Ishida | B41M 5/52 428/32.34 |
| 8,562,126 | B1 * | 10/2013 | Xiang | B41M 5/5218 347/101 |
| 2001/0041247 | A1 | 11/2001 | Scheffer et al. | |
| 2002/0025379 | A1 * | 2/2002 | Nakamura | D06P 5/30 427/322 |
| 2003/0077959 | A1 | 4/2003 | Cates et al. | |
| 2003/0157303 | A1 | 8/2003 | Li et al. | |
| 2004/0170778 | A1 * | 9/2004 | Tomita | B41M 5/52 428/32.1 |
| 2005/0245156 | A1 | 11/2005 | Cates et al. | |
| 2005/0272334 | A1 * | 12/2005 | Wang | D06M 11/44 442/93 |
| 2006/0088675 | A1 | 4/2006 | Hladik et al. | |
| 2006/0281849 | A1 | 12/2006 | Johnson | |
| 2008/0081160 | A1 * | 4/2008 | Anderle | B41M 5/52 428/195.1 |
| 2011/0102497 | A1 | 5/2011 | Sato et al. | |
| 2011/0169901 | A1 | 7/2011 | Pinto et al. | |
| 2014/0068877 | A1 * | 3/2014 | Ellis | D06P 5/22 8/467 |

FOREIGN PATENT DOCUMENTS

| | | |
|---|---|---|
| JP | 2001193189 | 7/2001 |
| JP | 2003335962 | 11/2003 |
| JP | 2004197237 | 7/2004 |

* cited by examiner

FABRIC PRINT MEDIUM

BACKGROUND

Inkjet printing technology has expanded its application to large format high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of medium substrates. Inkjet printing technology has found various applications on different substrates including, for examples, cellulose paper, metal, plastic, fabric, and the like. The substrate plays a key role in the overall image quality and permanence of the printed images. However, when printing on fabric substrates, challenges exist due to the specific nature of fabric. Accordingly, investigations continue into developing fabric medium substrates and printing methods that can be effectively used and which impart good image quality and durability for example.

BRIEF DESCRIPTION OF THE DRAWINGS

The drawings illustrate various embodiments of the present print medium and are part of the specification.

DETAILED DESCRIPTION

Figure 1:
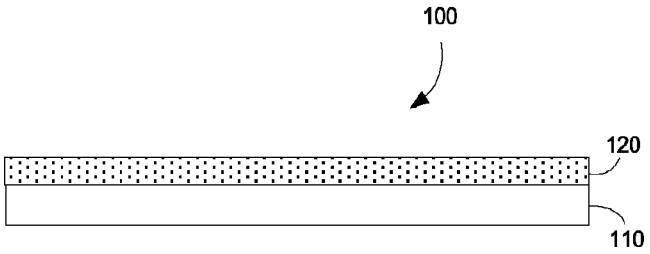
FIGS. 1 and 2 are cross-sectional views of the fabric print medium according to embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to a fabric print medium containing a fabric base substrate and a primer layer composition applied to said fabric base substrate. The primer layer composition encompasses at least three types of polymeric particles, at least two different fire retardant agents and a water-soluble high-valence metal complex. The present disclosure also relates to a method for forming said fabric medium substrate and to the printing method using said medium.

When printing of fabric substrates, challenges exist due to the specific nature of fabric. Indeed, often, fabric does not accurately receive inks. Some fabrics, for instance, can be highly absorptive, diminishing color characteristics, while some synthetic fabrics can be crystalline, decreasing aqueous ink absorption leading to ink bleed. These characteristics result in the image quality on fabric being relatively low. Additionally, black optical density, color gamut, and sharpness of the printed images are often poor compared to images printed on cellulose paper or other media types. Durability, such as rubbing resistance, is another concern when printing on fabric, particularly when pigmented inks and ink compositions containing latex are used. Furthermore, when fabric is intended to be used in close proximity to indoor environments (as drapes, as overhead signage, as part of furnishings, or the like), there are concerns about flame resistance as well as about using coatings that increase the flammability of the fabric. Thus, fire/flame resistance or inhibition characteristics are also desirable when providing printable fabrics.

The image printed on the fabric print medium of the present disclosure (i.e. which is treated by a primer layer composition including at least three types of polymeric particles, at least two different fire retardant agents and water-soluble high-valence metal complex), exhibits excellent printing qualities and durability. By using such primer composition, in combination with the fabric print medium, the printing process is more accurate and the printed image is more permanent. The resultant printed fabric will also have good water resistance properties while providing fire/flame resistance or inhibition to the fabric.

The present disclosure refers to a fabric print medium containing a fabric base substrate and a primer layer composition applied to said fabric base substrate. The primer layer composition encompasses at least three types of polymeric particles, at least two different fire retardant agents and a water-soluble high-valence metal complex.

Without being linked by any theory, it is believed that the primer layer composition, also called treatment composition, once applied on the fabric base substrate, forms a thin layer onto the fabric base surface. Said thin layer has a first structure before image formation on the fabric (e.g., using inkjet printing for example) and a second different structure once the ink has been applied. The first structure can be considered as porous and is configured to allow ink colorants to penetrate into the structure. The first structure formed from the treatment composition is transformed into a second structure, during printing process, to further protect the image after image formation. In some examples, the fabric base substrate has two sides, and both of the two sides are coated with the primer layer composition.

Figure 2:
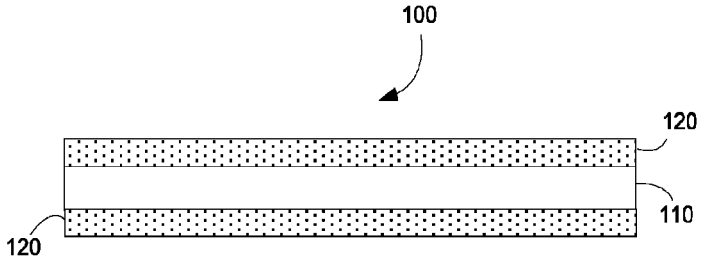

FIG. 1 and FIG. 2 illustrate the fabric print medium (100) as described herein. As illustrated in FIG. 1, the print medium (100) encompasses a fabric base substrate (110) and primer layer composition (120). The primer layer (120) is applied on one side of the bottom supporting substrate (110). If said coated side is used as an image-receiving side, the other side, i.e. backside, may not have any coating at all, or may be coated with other chemicals (e.g. sizing agents and backing adhesives) or coatings, or laminate with other materials such as backing paper and plastic film/sheet to meet certain features such as to balance the curl of the final product or to improve sheet feeding in printer. In some other examples, such as illustrated in FIG. 2, the primer layer composition (120) is applied to both opposing sides of the supporting fabric base substrate (110). The double-side coated media has thus a sandwich structure, i.e. both sides of the fabric base substrate (110) are coated with the same primer layer and both sides may be printed. The primer layers (120), that are applied on each side of the supporting fabric base substrate (110), can have different compositions in view of generating for specific properties; for instance, the primer layer composition that is applied on back (non-imaging) side may contains blocking agents in order to improve opacity of the fabric print medium.

The amount of the primer layer (120) on the fabric base substrate in the dry state is, at least, sufficient to hold all of the ink that is to be applied to the print medium. The fabric base substrate (110) can have a thickness along substantially the entire length ranging between about 0.025 mm and about 0.5 mm. In some examples, the primer layer composition (120) is disposed on the fabric base substrate (110) and forms a coating layer having a coat-weight in the range of about 0.1 to about 50 gram per square meter ($g/m^2$ or gsm) per side, or in the range of about 0.5 gsm to about 30 gsm, or in the range of about 3 to about 20 gsm, or in the range of about 5 to about 15 gsm per side.

Figure 3:
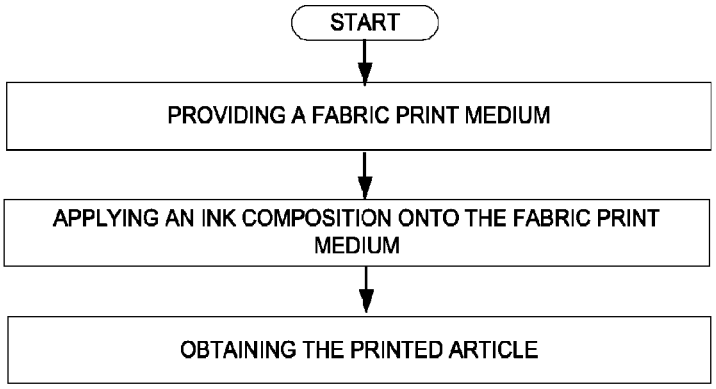
FIG. 3 is a flowchart illustrating the method for producing images according to some embodiments of the present disclosure.

An example of the printing method in accordance with the principles described herein, by way of illustration and not limitation, is shown in FIG. 3. FIG. 3 illustrates embodiments of the printing method that encompasses providing a fabric print medium, applying an ink composition onto said a print medium and obtaining a printed article.

The Fabric Base Substrate

Regarding the fabric base substrate, any textile, fabric material, fabric clothing, or other fabric product where there is a desire for application of printed matter can benefit from the principles described herein. More specifically, fabric substrates useful in present disclosure include substrates that have fibers that may be natural and/or synthetic. The term "fabric" as used to mean a textile, a cloth, a fabric material, fabric clothing, or another fabric product. The term "fabric structure" is intended to mean a structure having warp and weft that is one of woven, non-woven, knitted, tufted, crocheted, knotted, and presserayd, for example. The terms "warp" and "weft" refers to weaving terms that have their ordinary means in the textile arts, as used herein, e.g., warp refers to lengthwise or longitudinal yarns on a loom, while weft refers to crosswise or transverse yarns on a loom. It is notable that the term "fabric substrate" does not include materials commonly known as any kind of paper (even though paper can include multiple types of natural and synthetic fibers or mixture of both types of fibers). The paper thereon is defined as the felted sheet, roll and other physical forms which are made of various plant fibers (like trees or mixture of plant fibers) with synthetic fibers by laid down on a fine screen from a water suspension. Furthermore, fabric substrates include both textiles in its filament form, in the form of fabric material, or even in the form of fabric that has been crafted into finished article (clothing, blankets, tablecloths, napkins, bedding material, curtains, carpet, shoes, etc.).

In some examples, the fabric base substrate is woven, knitted, non-woven, or tufted and comprises natural or synthetic fibers selected from the group consisting of wool, cotton, silk, rayon, thermoplastic aliphatic polymers, polyesters, polyamides, polyimides, polypropelene, polyethylene, polystyrene, polytetrafluoroethylene, fiberglass, polytrimethylene, polycarbonates, polyester terephthalate and polybutylene terephthalate. In some examples, the fabric base substrate is a woven fabric where warp yarns and weft yarns are mutually positioned at an angle of about 90°. This woven fabric includes, but is not limited to, fabric with a plain weave structure, fabric with twill weave structure where the twill weave produces diagonal lines on a face of the fabric, or a satin weave.

The fabric base substrate can be a knitted fabric with a loop structure including one or both of warp-knit fabric and weft-knit fabric. The weft-knit fabric refers to loops of one row of fabric are formed from the same yarn. The warp-knit fabric refers to every loop in the fabric structure that is formed from a separate yarn mainly introduced in a longitudinal fabric direction. The fabric base substrate can also be a non-woven product, for example a flexible fabric that includes a plurality of fibers or filaments that are one or both of bonded together and interlocked together by a chemical treatment process (e.g., a solvent treatment), a mechanical treatment process (e.g., embossing), a thermal treatment process, or a combination of two or more of these processes.

The fabric base substrate can include one or both of natural fibers and synthetic fibers. Natural fibers that may be used include, but are not limited to, wool, cotton, silk, linen, jute, flax or hemp. Additional fibers that may be used include, but are not limited to, rayon fibers, or those of thermoplastic aliphatic polymeric fibers derived from renewable resources, including, but not limited to, corn starch, tapioca products, or sugarcanes. These additional fibers can be referred to as "natural" fibers. In some examples, the fibers used in the fabric base substrate includes a combination of two or more from the above-listed natural fibers, a combination of any of the above-listed natural fibers with another natural fiber or with synthetic fiber, a mixture of two or more from the above-listed natural fibers, or a mixture of any thereof with another natural fiber or with synthetic fiber.

The synthetic fiber that may be used in the fabric base substrate can be a polymeric fiber including, but not limited to, polyvinyl chloride (PVC) fibers, PVC-free fibers made of polyester, polyamide, polyimide, polyacrylic, polypropylene, polyethylene, polyurethane, polystyrene, polyaramid (e.g., Kevlar®) polytetrafluoroethylene (Teflon®) (both trademarks of E. I. du Pont de Nemours Company), fiberglass, polytrimethylene, polycarbonate, polyester terephthalate or polybutylene terephthalate. In some examples, the fibers include a combination of two or more of the above-listed polymeric fibers, a combination of any of the above-listed polymeric fibers with another polymeric fiber or with natural fiber, a mixture of two or more of the above-listed polymeric fibers, or a mixture of any of the above-listed polymeric fibers with another polymer fiber or with natural fiber. In some examples, the synthetic fiber includes modified fibers from above-listed polymers. The term "modified fibers" refers to one or both of the polymeric fiber and the fabric as a whole having underwent a chemical or physical process such as, but not limited to, one or more of a copolymerization with monomers of other polymers, a chemical grafting reaction to contact a chemical functional group with one or both the polymeric fiber and a surface of the fabric, a plasma treatment, a solvent treatment, for example acid etching, and a biological treatment, for example an enzyme treatment or antimicrobial treatment to prevent biological degradation.

In some examples, the fabric base substrate contains both natural fiber and synthetic polymeric fiber. The amount of synthetic polymeric fibers can represent from about 10% to about 90% of the total amount of fiber. The amount of natural fibers can represent from about 10% to about 90% of amount of fiber.

The fabric base substrate may further contains additives including, but not limited to, one or more of colorant (e.g., pigments, dyes, tints), antistatic agents, brightening agents, nucleating agents, antioxidants, UV stabilizers, fillers and lubricants, for example. Alternatively, the fabric base substrate may be pre-treated in a solution containing the substances listed above before applying the primer layer composition. The additives and pre-treatments are included in order to improve various properties of the fabric.

The Primer Layer Composition

The primer layer composition, applied to the fabric base substrate, is based on a treatment composition that includes at least three types of polymeric particles, at least two different fire retardant agents, and a water-soluble high-valence metal complex. Other functional additives can be added to the primer layer composition, for specific property control such as, for examples, optical brightener agent, optical brightener agent carrier, dyes for color hue, surfactant for wettability, and processing control agent such as deformer, and PH control base/acid buffer.

The primer layer composition, which is applied to the fabric base substrate, contains, at least, three types of polymeric particles. In some examples, the first polymeric particle is a film forming polymer particle. Such film forming polymer particles exist in a dispersed solid-liquid form such as, for examples, solvent dispersed polymeric powders, emulsion or latex. Film forming polymer particles could be defined as polymeric particles dispersed in a dispersion or latex, and such particles are able to "coalescence" or "fusing", by compaction, deformation, cohesion and/or polymer chain inter-diffusion in order to form a continuous film upon evaporation of the continuous phase of the dispersion. The "film forming" process can be done in a large scale (where continuous film are formed) and/or in a localized scale. Such film forming polymer particles can be in a coalescence state at a sub-room temperature range (−10° C. to 5° C. for example), at a room temperature range (5° C. to 40° C. for example) and at an elevated drying temperature range (40° C. to 120° C. for example). Film forming polymer particles, once film-formed, have strong binding properties to the fabric base substrate.

The first polymeric particles (or film forming polymer particles) can be made of natural or synthetic macromolecule compounds. In some examples, first polymeric particles are made of a polyurethane compounds. In some other examples, first polymeric particles are made of a modified polyacrylate compounds. Modified polyacrylates include copolymers of acrylic with methacrylic, acrylic acid, styrene, anhydride and other monomers with functional groups. The first polymeric particles can also be synthetic polymers such as polyvinyl alcohol and polyvinyl acetate. Natural polymers such as starches and chemically modified starches can also be used. The first polymeric particles can be formed by polymerization of organic monomers, inorganic monomers, and hybrids of organic and inorganic monomers. For illustration, an organic polymer, such as polyurethane or polyacrylate, can be grafted with some inorganic unites such as halogen groups, e.g., bromides, fluorides, and chlorides, phosphorus groups, and/or nitrogen groups. In some examples, the first polymeric particle has a low glass transition temperature, i.e. in the range of about −60° C. to about −5° C. and a high surface energy, i.e. in the range of about 35 to about 50 dyne/cm, when it is filmed. The first polymeric particle can be cationic, anionic, or neutral in charge when presented in aqueous or other solution in preparation for application to the fabric base substrate. However, in some examples, first polymeric particles are cationic or neutral compounds.

The particle size of the first polymeric particles varies according to fabric base substrate that is used. The particle size of first polymeric particles can be in the range of about 0.05 to about 2 micrometer (μm), or in the range of about 0.1 to about 1 μm. The first polymeric particles can be in a nano-meter range with a morphology of molecular colloid. Examples of such polymeric particles are those made from, for example, virginal starch, chemical modified starch, polyvinyl alcohol, polyethylene oxide and polyvinylpyrrolidone. First polymeric particles are able to have an adhesion to all solid particles in the primer layer composition and to the fabric base substrate once they are film-formed. This adhesion strength is constant in the fabric application range (i.e. room temperature), and the adhesion loss in the elevated temperatures (i.e. drying temperature inside a printer), does not excess 20% of the adhesion in room temperature.

The second polymeric particle, that is present in the primer layer composition, is a non-film forming polymeric particle that exists in a dispersed solid-liquid form such as solvent dispersed polymeric powders, emulsion or latex. Non-film forming polymeric particles refer to particles that have no substantial coalescence under manufacture and storage conditions (by opposition to the first polymeric particle, i.e. film forming polymer particle). In more details, upon evaporation of the continuous phase (such as solvent and/or water of the dispersed solid-liquid system), the polymeric particles are able to resist particle deformation and further coalescence. In some examples, second polymeric particles are non-deformable particles.

As "non-deformable particle", it is meant herein that the particles present two distinct physical forms during the printing process. Before printing, the particles are non-deformable during manufacturing and storing of the finished fabric medium, but can transform into a secondary physical form in which the particles deform and form a film under printing temperature conditions of the printing process. Thus, particles layers are rigid and can form a porous array, in a first morphology state, before printing, but are also able to coalesce and flow to form a localized film and even large scale film layer, due at least in part to the rise in temperature, during cure processing of printing. Without being linked by any theory, it is believed that such morphology transformation helps ink colorants to have a good penetration and to form a good image quality print-out while second formation results in an encapsulated structure of ink colorants that improve image durability.

The intrinsic non-deformable properties of polymeric particles are defined by the Minimum Film Formation Temperature (MFFT) of the particles. The MFFT is dependent on the elastic modulus of the polymer, and to a lesser extent, on the viscosity of the polymer. The MFFT could be defined as the minimum temperature at which the polymeric particles will coalesce when laid on a substrate as a thin film, and is determined by the use of a MFFT Bar with the test condition described in ASTM D 2354. In some examples, the minimum film formation temperature (MFFT) of the non-deformable particle is greater than 80° C., or greater than 100° C. In some other examples, Minimum Film Formation Temperature (MFFT) of the non-deformable particles, i.e. second polymeric particles, is of about 125° C.

Second polymeric particles, non-deformable polymeric particles, can be reactive polymeric particles or non-reactive polymeric particles. "Reactive polymeric particles" include particles that are capable of cross-linking (either via self-cross-linking, e.g., within a single molecule chain, or among multiple molecule chains, such as in the presence of a cross-linking agent) upon exposure of heat during printing. Under such conditions, the reactive polymeric particles may coalesce so that the reactive polymer particles flow together to form a film due at least in part to chemical bonding generated in the cross-linking reaction. The cross-linking of the reactive polymer particles can form a continuous, substantially non-porous protective film that is both heat flowed and cross-linked. The reactive polymer particles selected are not limited, as long as macromolecular chains of the particles are capable of the cross-linking reaction mentioned above. Specific examples of polymer particles include particles of a polymer having an epoxy functionality on a backbone of the polymer, particles of a polymer having an epoxy functionality on a side chain of the polymer, particles of a polymer having fatty acid groups, particles of a polymer having alkoxy-silane groups, particles of a polymer having acetoacetoxy groups, particles of a polymer having hydroxyl groups, particles of a polymer having amine groups, and particles of a polymer having carboxyl groups.

"Non-reactive polymeric particles" include particles that do not initialize a cross-linking reaction. However, upon exposure to the heat during printing, non-reactive polymeric particles can coalesce, flowing together to form a film due to the rise in temperature above its glass transition temperature (Tg). The coalescing of the non-reactive polymer particles forms a continuous, substantially non-porous protective film that remains uncross-linked. Non-reactive particles can be selected from polymers formed by polymerization and/or copolymerization of hydrophobic addition monomers. Examples of hydrophobic addition monomers include, but are not limited to, $C_1$-$C_{12}$ alkyl acrylate and methacrylate monomers (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic acid containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomers, $C_1$-$C_{12}$ alkyl acrylamide and methacrylamide monomers (e.g., t-butyl acrylamide, sec-butyl acrylamide, N,N-dimethylacrylamide), and olefin monomers (e.g., polyethylene, polypropylene, and co-polymers). The second polymeric particles can also be selected from polytetrafluoroethylene (PTFE), silica, silicone, paraffin wax, carnauba wax, montan wax, and combinations.

The third polymeric particle, that is present in the primer layer composition, is a poly-alkene compound. By poly-alkene compound, it is meant herein that the third polymeric particle is made, for instance, from a poly-alkene homopolymer, a poly-alkene copolymer, a modified poly-alkene, a combination of two or more of the above-listed poly-alkenes, or a mixture of two or more thereof. By definition, a "poly-alkene" herein refers to a polymeric material formed via polymerization of an alkene monomer, i.e., $C_nH_{2n}$ and its derivatives, where n is within a range of about 7,000 to about 20,000. Examples of the polymers used to make the third polymeric particles include, but are not limited to, polyethylene homopolymer, polypropylene homopolymer, polytetrafluoroethylene (PTFE), amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, a combination of two or more of the above-listed poly-alkenes, or a mixture of two or more of the above-listed poly-alkenes. In some examples, the third polymeric particles have a hardness value less than about 2 dmm, as measured by ASTM D-5 method. In some other examples, the third particles have a hardness value less than about 1, or less than about 0.5 dmm.

The size of the third polymeric particles is larger than the size of the first and second particles described above. In some examples, the size of the third polymeric particles can be 50 times larger than the size of the first polymeric particles, or can be 75 times larger than the size of the first polymeric particles, or can be 100 times larger than the size of the first polymeric particles. Third polymeric particles are rigid and temperature-resistant particles. The "temperature-resistant" refers to the fact that the change in the rigidness will be kept substantially minimal under the fabric manufacture and storage conditions, even if third polymeric particles can be made from the thermal plastic and thermal-set polymers. In addition, unlike second polymeric particles described above, third polymeric particles will not change its morphology (such as melting, collapse, and coalescence together) under printing condition. The temperature-resistant of the third polymeric particles could be monitored by its softening temperature as defined and measured by the industrial standard ASTM D6493 or ISO 4625. In some examples, the softening temperature of the third polymeric particle is greater than 120° C. or in the temperature range of about 130° C. to about 200° C. Without being linked by any theory, with said chemical and physical characteristics, the third polymeric particles are thought to provide a high durability (especially high anti-abrasion capability) to the printed image.

In some examples, the primer layer composition comprises first polymeric particles that are film forming polymers; second polymeric particles that are non-deformable particles and third polymeric particles that are poly-alkene compounds. In some other examples, the primer layer composition comprises first polymeric particles that are polyurethane compounds, second polymeric particles that are reactive or non-reactive polymeric particles and third polymeric particles that are poly-alkene compounds.

The weight ratio of the first, second and third polymeric particles vary according to the chemical nature and surface morphology of the fabric base substrate. For instance, a non-chemical polar surface and/or a physical rough surface would involve a higher weight percent of first polymeric particles. In some examples, the weight ratio between the first polymeric particles, the second polymeric particles and the third polymeric particles are within a range of 1-15/5-40/3-25. In some other examples, the weight ratio between the first, second and third polymeric particles could be 5/35/16 or 10/35/16 or 5/30/10.

The primer layer composition that is applied to the fabric base substrate further includes, at least, two different fire retardant agents. The fire retardant agents, or flame inhibitors, or flame resistant compounds, refer to any substance that has the effect of reducing flammability or inhibiting the combustion of the fabric medium. While the fire/flame retardant agents provide the function of reducing flammability and inhibiting combustion, some fire retardant agents impact the ink adhesion to the fabric base substrate adversely. Such impact could reduce the durability of printed image. To balance said controversial effects, two different types of fire retardant agents, with different chemical structure and physical form, are present in the primer layer composition. In some examples, the two fire retardant agents are present in two different states: a first fire retardant agent is in a solid state and a second fire retardant agent is in a liquid state in the ambient temperature (i.e. between about 18° C. to about 25° C.). The first fire retardant agent can be in a solid state in the ambient temperature, in the form of a fine powder for instance. The average diameter of the powder particulate can be less than 5 μm, or less than 1 μm and even less 0.5 μm. The second fire retardant agent can be in a liquid state and is compatible with aqueous solvent in the ambient temperature. Any halogenated compounds and compounds containing heavy metal elements are considered toxic to the environment and are therefore excluded from the fire retardant agents used in the primer layer composition of the present disclosure.

The first fire retardant agents can be a non-halogenated compound or an organophosphate compound. In some examples, the first fire retardant agents are non-halogenated compounds Examples of non-halogenated compounds include phosphorus-containing compounds and nitrogen-containing compounds. Phosphorus-containing compounds including organic and inorganic phosphates, phosphonates, and/or phoshphinates with different oxidation states are effective for use. Nitrogen-containing compounds that can likewise be used include melamines (including melamine derivatives) such as melamine cyanurate, melamine polyphosphate, melem and melon. Non-halogenated compounds are often considered to be environmentally friendly. Examples of organophosphate compounds include aliphatic phosphates and phosphonates and aromatic phosphonates. The organophosphate compound can be an organophosphonate with four oxygen atoms attached to the central phosphorus; an aliphatic, aromatic, or polymeric organophosphate with 3 oxygen atoms attached to the central phosphorus, or an organophosphinate with 2 oxygen atoms attached to the central phosphorus atom. Formula I below provides a general formula for an organophosphonate, Formula II sets forth an organophosphate that can be aliphatic organophosphate, an aromatic organophosphate, or an organophosphate polymer; and Formula III provides a formulaic example of organophosphinates. Thus, the organophosphates used in accordance with examples of the present disclosure can have general Formula I-III, as follows:

Formula I

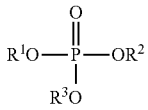

Formula II

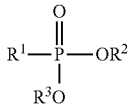

Formula III

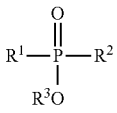

where $R^1$, $R^2$, and $R^3$ are individually organic or inorganic substituents that can be different or the same, including $C_1$-$C_{12}$ branched or straight chained alkyl, aryl, and bisphosphate. Specific examples of organophosphates include diphenyl-phosphate (TPP), resorcinol bis(diphenylphosphate) (RDP), bisphenol A diphenyl-phosphate (BADP), tricresyl-phosphate (TCP); dimethyl-phosphonate, 2,2-Oxy-bis[5,5-dimethyl-1,3,2-dioxaphosphorinane]2,2-disulphide, bisphenol-A-bis(diphenyl-phosphate)diethyl-phosphonate, diethylphosphinate aluminum salt, dimethyl-propyl-phosphonate, diethyl N,N-bis(2-hydroxyethyl), aryl-phosphates, cresyl diphenyl-phosphate (diphenyl-tolyl-phosphate); cyclic phosphonate; diethyl-ethyl phosphonate, dimethyl-methyl-phosphonate; diphenyl (2-ethylhexyl) phosphate or the like. Compounds having a molecular structure that includes both nitrogen and phosphorus also show acceptable properties. Examples of such compounds include APP (ammonium polyphosphate), PDSPB (poly (4,4-diaminodiphenyl methane spirocyclic pentaerythritol bisphosphonate)), DTPAB (1,4-di(diethoxy thiophosphamide benzene), aminomethyl phosphonate, ethylenediamine-o-phosphate, modified guanidine phosphate, melamine phosphate, melamine polyphosphate, melamine-poly(aluminium phosphate) and mixtures thereof. Compounds having a molecular structure that includes both metal element and phosphorus also show acceptable properties. Examples of such compounds include aluminum diethylphosphinate, calcium diethylphosphinate and mixtures thereof. Compounds containing both phosphorus and a halogen show less adverse environmental impact and can be selected as the first fire retardant agent. Such compounds include tris(2,3-dibromopropyl) phosphate and chlorinated organophosphates such as tris(1,3-dichloro-2-propyl)phosphate (TDCPP), tetrekis(2-chlorethyl) dichloroisopentyldiphosphate, tris(1,3-dichloroisopropyl) phosphate, tris(2-chloroisopropyl) phosphate, tris(2-chloroisopropyl) phosphate. The first fire retardant agent can be also selected from mineral powders such as aluminum hydroxide (ATH), magnesium hydroxide, huntite and hydromagnesite hydrates, red phosphorus, boehmite (aluminum oxide hydroxide) and boron compounds, like borates.

The primer layer composition that is applied to the fabric base substrate includes, at least, two fire retardant agents with different chemical structure and physical form; i.e. a first fire retardant agent is in a solid state and a second fire retardant agent is in a liquid state. In some examples, the second fire retardant agent is used is in liquid form and is aqueous or water compatible. The second fire retardant can be water-soluble phosphorus-containing compounds. Example of phosphorus-containing compound is a phosphonate ester with a phosphorus-containing closed 4- to 6-membered ring structure. An example of such a compound is 5-ethyl-2-methyl-1,3,2-dioxaphosphorinan-5-yl)methyl dimethyl phosphonate P-oxide, having the formula IV

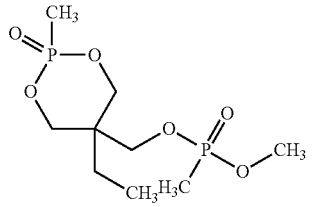

Another example is bis[(5-ethyl-2-methyl-1,3,2-dioxaphosphorinan-5-yl)methyl]methyl phosphonate P,P'-dioxide, having the following Formula V:

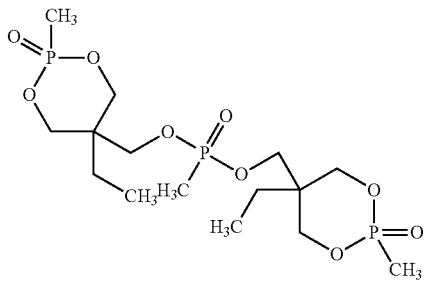

Other phosphonate esters with phosphorus-containing closed ring structure can be selected from some commercial available products, such as FR-102® (available from Shanghai Xusen Co Ltd) and Aflammit® (available from Thor).

The fabric print medium of the present disclosure contains a fabric base substrate and a primer layer composition that encompasses, at least, two different fire retardant agents. In some examples, the first fire retardant agent is a non-halogenated compound or an organophosphate compound and the second fire retardant agent is a water-soluble phosphorus-containing compound. The fire retardant agents can be present, in the primer layer composition, at a weight ratio of fire retardant agents to polymeric particles, of about 90:10 to 30:70.

In the primer layer composition of the fabric print medium, as defined herein, the fire retardant agents are present in an amount representing more than 2 wt % by total weight of the fabric base substrate and of the polymeric particles. (Specifically, if the fabric print medium has not been pre-treated with any fire retardant agents before applying the primer layer). The amount of fire retarding agents represents the sum of the amounts of the first and of the second fire retardant agents. In some examples, the total amount of fire retardant agents the can be within the range of about 2 to about 10 wt % by total weight of the fabric base substrate and of the polymeric particles. The amount of fire retardant agents can also represent above 2 wt % of the total weight of the polymeric particles (specifically, if the fabric base substrate has been pre-treated with a fire retardant agents, in order to meet specified fire retardant standard, before applying the primer layer composition).

The primer layer composition that is applied to the fabric base substrate includes a water-soluble high-valence metal complex. Such water-soluble high-valence metal complex can be a water-soluble compound containing high-valence metallic ion, a water-soluble cationic high-valence metallic complex or a water-soluble cationic polymeric compounds containing high-valence metallic ion.

Water-soluble high-valence metallic ions can be high-valence metallic cation or anion. Suitable cation species can include one or more of Group II metals, Group III metals or transition metals from the period table, such as, for instance, calcium, copper, nickel, zinc, magnesium, barium, iron, aluminum and chromium ions. Anion species can include one or more of chloride, iodide, bromide, nitrate, sulfate, sulfite, phosphate, chlorate, and acetate. In some examples, the water-soluble high-valence metal complex is a water-soluble aluminum salt. In some other examples, the water-soluble high-valence metal complex is a water-soluble trivalent aluminum salt. Examples of such salts include aluminum acetate, aluminum bromate, aluminum bromide and the hexa- and pentadecyl hydrates thereof, aluminum ammonium sulfate, aluminum sodium sulfate, aluminum chlorate, aluminum citrate, aluminum chloride and the hexahydrate thereof, aluminum fluoride, aluminum iodide and the hexahydrate thereof, aluminum lactate, aluminum nitrate, aluminum stearate, aluminum sulfate, aluminum tartrate, aluminum triformate, aluminum formo-acetate and the hydrate.

The water-soluble high-valence metal complex can be a water-soluble cationic high-valence metallic complex. Such water-soluble cationic high-valence metallic complex can be a charged complex ion derived from a metal complex with coordinate covalent bonds or dative covalent bonds. The coordination number is defined by the number of ligand(s) attached to the central metal ion, and may range from two to nine, or even more. The ligands can be small polar molecules, such as $H_2O$ and $NH_3$, or can be anions such as $Cl^-$, $OH^-$ and $S^{2-}$. Examples of water-soluble high-valence metal complexes include $[Al(H_2O)_6]^{3+}$, $[Al(H_2O)_3(OH)_3]$, $[Al(H_2O)_2(OH)_4]$, and $[Al(H_2O)_4(OH)_2]$. Other example includes potassium aluminum sulfate dodecahydrate. Alternatively, the metal complex can include two or more central atoms, also referred to as polynuclear complexes, which can be formed when a ligand donates electron pairs to two or more metal ions simultaneously and then acts as bridge between the multiple central ions. In some examples, the charged complex ions can be octa-aquo-dioxodialuminim (iV)$^{4+}$, $Al_8(OH)_{20}{}^{4+}$ or $[Al_8(OH)_{10}(SO_4)_5]^{4+}$. Other types of multivalent metal salts without similar complex structure as described above may also be used to similar effect. For example, aluminum fluorosulfate and aluminum chloride can also be used. The inclusion of one of these salts or other similar salt can improve the print quality and optical density of printed areas on fabrics.

The water-soluble high-valence metal complex can be a water-soluble cationic polymeric compound containing high-valence metallic ion. Examples of such cationic polymer include: poly-diallyldimethylammonium chloride, polydiallylamine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propylamino)ethylstyrene, poly2-(N,N-diethylamino)ethyl methacrylate, poly 2-(diethylamino)ethylstyrene, and 2-(N,N-dimethylamino) ethyl acrylate, to name a few.

The water-soluble high-valence metal complex, as defined herein, present in the primer layer composition that is applied to the fabric base substrate, can be used in an amount representing from about 0.1 wt % to 20 wt % (dry weight), or from 0.5 wt % to 10 wt % (dry weight), by total dry weight of the primer layer composition.

The primer compositions can be prepared in a liquid carrier in order to disperse or solubilize primer layer composition components. Such liquid carrier is, for example, an aqueous solvent such as water and low boiling point alcohol. The liquid carrier can be removed, at least in part, from the final product once the primer layer composition is applied to the fabric. The liquid carrier may include water, cosolvents, surfactants, viscosity modifying agents, inorganic compounds, pH control agents and/or deformers. The primary function of the carrier is to dissolve/disperse and/or carry the solids or other components that remain on the fabric as a coating, and to provide a carrier that will suitably carry all the components in the composition and help them uniformly distribute on the fabric base surface. There is no specific limitation on selection of the carrier components, as long as the carrier as a whole has the function described above.

Method for Forming a Fabric Print Medium

The fabric print medium is prepared by using a surface treatment composition herein named a primer layer (or coating) composition. A method for forming the fabric print medium, according to the present disclosure, encompasses providing a fabric base substrate; impregnating said fabric base substrate with a primer layer composition to form a primer layer, said composition including at least three types of polymeric particles, at least two different fire retardant agents, and a water-soluble high-valence metal complex; drying the fabric substrate under heat to form a fabric print medium.

The application of the primer layer composition to the fabric base substrate can be carried out using padding procedures. The fabric substrate can be soaked in a bath and the excess can be rolled out. More specifically, impregnated fabric substrates (prepared by bath, spraying, dipping, etc.) can be passed through padding nip rolls under pressure to provide a dry picked up from about 0.5 to about 50 gsm, though this range is not limiting. The impregnated fabric, after nip rolling, can then be dried under heat at any functional time which is controlled by machine speed with peak fabric web temperature in the range of about 90° C. to about 120° C. In some examples, pressure can be applied to the fabric substrate after impregnating the fabric base substrate with the primer layer composition. In some other examples, the surface treatment is accomplished in a pressure padding operation. During such operation, the fabric base substrate is firstly dipped into a pan containing treatment primer layer composition and is then passed through the gap of padding rolls. The padding rolls (a pair of two soft rubber rolls or a metal chromic metal hard roll and a tough-rubber synthetic soft roll for instance), apply the pressure to composite-wetted textile material so that composite amount can be accurately controlled. In some examples, the pressure, that is applied, is between about 10 and about 100 PSI or, in some other examples, is between about 30 to about 70 PSI.

The dry amount of the primer layer (or coating) composition, that is applied to the fabric base substrate, can be in the range of about 0.1 to about 50 gram per square meter or in the range of about 0.5 gsm to about 30 gsm, or in the range of about 3 to about 20 gsm, or in the range of about 5 to about 15 gsm.

The primer layer composition can be dried using box hot air dryer. The dryer can be a single unite or could be in a serial of 3 to 7 unites so that a temperature profile can be created with initial higher temperature (to remove excessive water) and mild temperature in end unites (to ensure completely drying with a final moisture level of less than 1-5% for example). The peak dryer temperature can be programmed into a profile with higher temperature at begging of the drying when wet moisture is high and reduced to lower temperature when web becoming dry. The dryer temperature is controlled to a temperature of less than about 160° C. to avoid yelling textile, and the fabric web temperature is controlled in the range of about 90 to about 120° C. In some examples, the operation speed of the padding/drying line is 50 yards per minute.

Printing Method

Once the primer layer composition is applied to the fabric base substrate and appropriately dried, ink compositions can be applied by any processes onto the fabric print medium. In some examples, the ink composition is applied to the fabric print medium via inkjet printing techniques. The printing method encompasses obtaining a fabric print medium containing a fabric base substrate and a primer layer composition applied to the fabric base substrate, said primer composition including at least three types of polymeric particles, at least two different fire retardant agents and a water-soluble high-valence metal complex; and, then, applying an ink composition onto said fabric print medium to form a printed image. Said printed image will have, for instance, enhanced image quality and image permanence. In some examples, when needed, the printed image can be dried using any drying device attached to a printer such as, for instance, an IR heater.

In some examples, the ink composition is an inkjet ink composition that contains one or more colorants that impart the desired color to the printed message and a liquid vehicle. As used herein, "colorant" includes dyes, pigments, and/or other particulates that may be suspended or dissolved in an ink vehicle. The colorant can be present in the ink composition in an amount required to produce the desired contrast and readability. In some examples, the ink compositions include pigments as colorants. Pigments that can be used include self-dispersed pigments and non-self-dispersed pigments. Any pigment can be used; suitable pigments include black pigments, white pigments, cyan pigments, magenta pigments, yellow pigments, or the like. Pigments can be organic or inorganic particles as well known in the art. As used herein, "liquid vehicle" is defined to include any liquid composition that is used to carry colorants, including pigments, to a substrate. A wide variety of liquid vehicle components may be used and include, as examples, water or any kind of solvents.

In some other examples, the ink composition, applied to fabric print medium, is an ink composition containing latex components. Latex components are, for examples, polymeric latex particulates. The ink composition may contain polymeric latex particulates in an amount representing from about 0.5 wt % to about 15 wt % based on the total weight of the ink composition. The polymeric latex refers herein to a stable dispersion of polymeric micro-particles dispersed in the aqueous vehicle of the ink. The polymeric latex can be natural latex or synthetic latex. Synthetic latexes are usually produced by emulsion polymerization using a variety of initiators, surfactants and monomers. In various examples, the polymeric latex can be cationic, anionic, or amphoteric polymeric latex. Monomers that are often used to make synthetic latexes include ethyl acrylate; ethyl methacrylate; benzyl acrylate; benzyl methacrylate; propyl acrylate; propyl methacrylate; iso-propyl acrylate; iso-propyl methacrylate; butyl acrylate; butyl methacrylate; hexyl acrylate; hexyl methacrylate; octadecyl methacrylate; octadecyl acrylate; lauryl methacrylate; lauryl acrylate; hydroxyethyl acrylate; hydroxyethyl methacrylate; hydroxyhexyl acrylate; hydroxyhexyl methacrylate; hydroxyoctadecyl acrylate; hydroxyoctadecyl methacrylate; hydroxylauryl methacrylate; hydroxylauryl acrylate; phenethyl acrylate; phenethyl methacrylate; 6-phenylhexyl acrylate; 6-phenylhexyl methacrylate; phenyllauryl acrylate; phenyllauryl methacrylate; 3-nitrophenyl-6-hexyl methacrylate; 3-nitrophenyl-18-octadecyl acrylate; ethyleneglycol dicyclopentyl ether acrylate; vinyl ethyl ketone; vinyl propyl ketone; vinyl hexyl ketone; vinyl octyl ketone; vinyl butyl ketone; cyclohexyl acrylate; methoxysilane; acryloxypropyhiethyldimethoxysilane; trifluoromethyl styrene; trifluoromethyl acrylate; trifluoromethyl methacrylate; tetrafluoropropyl acrylate; tetrafluoropropyl methacrylate; heptafluorobutyl methacrylate; butyl acrylate; iso-butyl methacrylate; 2-ethylhexyl acrylate; 2-ethylhexyl methacrylate; isooctyl acrylate; and iso-octyl methacrylate.

In some examples, the latexes are prepared by latex emulsion polymerization and have an average molecular weight ranging from about 10,000 Mw to about 5,000,000 Mw. The polymeric latex can be selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers and acrylonitrile-butadiene polymers or copolymers.

The latex components are on the form of a polymeric latex liquid suspension. Such polymeric latex liquid suspension can contain a liquid (such as water and/or other liquids) and polymeric latex particulates having a size ranging from about 20 nm to about 500 nm or ranging from about 100 nm to about 300 nm.

EXAMPLES

Ingredients

TABLE 1

| Ingredient name | Nature of the ingredients | supplier |
|---|---|---|
| Acronal ®NX3587 | Aqueous acrylate film-forming copolymer | BASF |
| Raycat ®78 | non-film forming polyacrylic emulsion polymer | Specialty Polymers |
| Slid Ady ® SL-300 | Dispersed non-deformable polymer | Elementis Specialties |
| Pekoflam ® G-B5nb liquid | Liquid fire retardant | Clariant |
| Eagleban ® FRA-4117 | Dispersed solid fire retardant | Eagle Performance products |
| Aluminum sulfate octadeca hydrate | High-valence metallic salt | Aldrich Inc |

Example 1—Preparation of Print Medium

A fabric base substrate of 100% woven polyester, with a poplin weave structure, having a weight of 157 gsm is used. Different primer layer compositions, as formulated in Table 2, are applied to said fabric bases. A knitting fabric base is used as a comparative example.

Primer layer compositions are formulated, using a lab mixer of about 1 Liter batch size, at room temperature, according to the formulation (in parts by weight) summarized in Table 2. The final solution is adjusted by adding deionized water to solids content of 3% by weight. The primer layer (or treatment composition) TC 1 is formulated according to the principles described herein; primer layer compositions TC2 to TC 5 are comparative examples. The individual solids components are provided in parts by weight.

TABLE 2

| Ingredients | TC1 | TC2 | TC3 | TC4 | TC5 |
|---|---|---|---|---|---|
| Acronal ®NX3587 | 5 | 5 | 5 | 0 | 5 |
| Raycat ®78 | 34 | 34 | 34 | 37 | 45 |
| Slid Ady ®300 | 16 | 16 | 16 | 18 | 30 |
| Pekoflam ® G-B5nb liquid | 23 | 0 | 43 | 23 | 10 |
| Eagleban ® FRA-4117 | 20 | 43 | 0 | 20 | 8 |
| Aluminum sulfate octadeca hydrate | 2 | 2 | 2 | 2 | 2 |

The fabric substrates are impregnated using the primer compositions (TC1 to TC5) of Table 2 and passed through padding nip rollers with a nip pressure about 70 PSI to achieve a wet pick up of from 40 to 60%. The impregnated substrates are then dried in a convection oven at 220° F. to 240° F. with a drying speed of 2 feet per minute to form various primer layers. Table 3 below sets forth the various combinations of primer layers and fabric base substrates prepared in accordance with these preparative steps.

TABLE 3

| Sample ID | Fabric base | Treatment composition |
|---|---|---|
| EX 1 | Woven fabric | TC1 |
| EX 2 (comparative) | Woven fabric | TC2 |
| EX 3 (comparative) | Woven fabric | TC3 |
| EX 4 (comparative) | Woven fabric | TC4 |
| EX 5 (comparative) | Woven fabric | TC5 |
| EX 6 Commercial Comparative 1 | Woven fabric | N/A |
| EX 7 Commercial Comparative 2 | Knitting fabric | N/A |

Example 2—Image Quality and Fabric Print Medium Performances

Once the fabric print medium is prepared as described above, an identical image sequence is printed on said fabric print medium (EX1 to EX5) and on the comparative samples (E×6 and E×7) using a HP DesignJet L26500 Printer equipped with HP 792 ink cartridges. The printer is set with a heating zone temperature at about 50° C., a cure zone temperature at about 110° C. and an air flow at about 15%. Image quality, ink adhesion, water resistance and fire retardancy are evaluated on the printed images. The results are illustrated in the Table 4 below.

Image quality tests are conducted by measuring parameters such as such as color gamut, black and color ink density, L*min, ink bleed level and ink coalescence. The image gamut, black and color ink density, L*min and black optical density (KOD) are measured on Macbeth® TD904 (Macbeth Process measurement). The global image quality of the prints related with ink migration such as bleeding and coalescence, are evaluated visually from the printed samples with the scale 1-5 (with 1 the worst and 5 is best).

Ink adhesion tests are carried out for dry rub resistance and resistance to damage due to folding or creasing of printed images. Rub resistance testing is carried out using an abrasion scrub tester (per ASTM D4828 method): fabrics are printed with small patches of all available colors (cyan, magenta, yellow, black, green, red, and blue). A weight of 250 g is loaded on the test header. The test tip is made of acrylic resin with crock cloth. The test cycle speed is 25 cm/min and 5 cycles are carried out for each sample at an 8 inch length for each cycle. The test probe is in dry (dry rub) or wet (wet rub) mode. The damage on the image is evaluated visually using a scale of 1-5 (with 1 being the worst and 5 being the best).

Water-resistance (or water-fastness) is evaluated using three techniques: water drip, water immersion, and detergent washing. The water drip test is conducted by applying deionized water on printed samples and observing the water damage on the image. The protocol for the water drip test is as follows: First, 3 inch×3 inch squares are printed, one square for each colorant to be tested (100% density), making sure there is 2-3 inches of white/unprinted material around each printed patch. Next, a lab eye-dropper tool is used to dispense 6-7 drops of deionized water into the center of each square. This is repeated immediately for each square and then it is allowed to dry on flat table for several hours to one day. After the drying time is complete, the images are examined for permanent halos/circles forming around the printed patches. Hallowing or circles indicates flowing of additive/surface treatment agents in the material which is unfavorable. Water immersion is carried out by immersing the printed images in water until completely soaked, and allowing the soaked images to dry. The protocol for the detergent washing test is first to add 2 gallons of tap water (ambient temperature) into 5 gallon bucket, and then add hand washing soap (e.g., Woolite® using recommended dosage from the soap supplier. The printed fabric sample is soaked for 5 minute, hand squeezed for 1 with medium force, and then soaked for an additional 5 minutes. Next, the soapy water is dumped out and plain tap water was added (2 gallons) and swished for 1 minute. After drying the damage on the image is evaluated visually using a scale of 1-5 (with 1 being the worst and 5 being the best).

Fire retardancy is evaluated by Diversified Test Lab Inc, complying with FR NFPA 701 standard.

TABLE 4

| Sample ID | Ink adhesion | Color Gamut | Water resistance | Fire retardancy | Global Image quality |
|---|---|---|---|---|---|
| EX 1 | 4+ | 290K | 5 | pass | 5 |
| EX 2 (comparative) | 4+ | 262K | 3 | pass | 3 |
| EX 3 (comparative) | 2 | 284K | 4+ | pass | 5 |
| EX 4 (comparative) | 1 | 247K | 5 | pass | 2 |
| EX 5 (comparative) | 5 | 293K | 5 | fail | 5 |
| EX 6 Commercial comparative | 2 | 230K | 1 | pass | 4 |
| EX 7 Commercial comparative | 2 | 238K | 2+ | pass | 4 |

As can be seen by the test results above, the fabric print medium according to the present disclosure provides several advantages over the comparative sample in terms of ink adhesion, image quality, water resistance and fire retardancy. It is noted that though some comparative medium performed well in some categories, they performed poorly in others. In accordance with examples of the present disclosure, over all of these tests, performance is collectively better when using the fabric print medium described herein.

The invention claimed is:

1. A fabric print medium comprising:

a. a fabric base substrate;

b. a primer layer composition applied to the fabric base substrate, the primer layer composition including:

i. at least three types of polymeric particles, ii. at least two different fire retardant agents, iii. and a water-soluble high-valence metal complex.

2. The fabric print medium of claim 1 wherein the primer layer composition forms, on the fabric base substrate, a coating layer having a coat-weight in the range of about 0.1 to about 50 gram per square meter.

3. The fabric print medium of claim 1 wherein the fabric base substrate is woven, knitted, non-woven or tufted and comprises natural or synthetic fibers selected from the group consisting of wool, cotton, silk, rayon, thermoplastic aliphatic polymers, polyesters, polyamides, polyimides, polypropelene, polyethylene, polystyrene, polytetrafluoroethylene, fiberglass, polytrimethylene, polycarbonates, polyester terephthalate and polybutylene terephthalate.

4. The fabric print medium of claim 1 wherein the primer layer composition comprises first polymeric particles that are film forming polymers; second polymeric particles that are non-deformable particles and third polymeric particles that are poly-alkene compounds.

5. The fabric print medium of claim 1 wherein the primer layer composition comprises first polymeric particles that are polyurethane compounds, second polymeric particles that are reactive or non-reactive polymeric particles and third polymeric particles that are poly-alkene compounds.

6. The fabric print medium of claim 1 wherein, in the primer layer composition, the fire retardant agents are present in an amount representing more than 2 wt % by total weight of the fabric base substrate and of the polymeric particles.

7. The fabric print medium of claim 1 wherein, in the primer layer composition, a first fire retardant agent is in a solid state and a second fire retardant agent is in a liquid state in the ambient temperature.

8. The fabric print medium of claim 1 wherein, in the primer layer composition, the first fire retardant agents is a non-halogenated compound or an organophosphate compound and the second fire retardant is a water-soluble phosphorus-containing compound.

9. The fabric print medium of claim 1 wherein, in the primer layer composition, the water-soluble high-valence metal complex is a water-soluble compound containing a high-valence metallic ion, a water-soluble cationic high-valence metallic complex or a water-soluble cationic polymeric compounds containing high-valence metallic ion.

10. The fabric print medium of claim 1 wherein, in the primer layer composition, the water-soluble high-valence metal complex is water-soluble aluminum salts.

11. A method for forming a fabric print medium comprising:

a. providing a fabric base substrate;

b. impregnating said fabric base substrate with a primer layer composition, said composition including at least three types of polymeric particles, at least two different fire retardant agents and a water-soluble high-valence metal complex;

c. drying the fabric substrate under heat to form a fabric medium substrate.

12. The method of claim 11 wherein pressure is applied to the fabric base substrate after impregnating said fabric with the primer layer composition.

13. A printing method comprising:

a. obtaining a fabric print medium comprising a fabric substrate and a primer layer composition applied to the fabric substrate, the primer composition including at least three types of polymeric particles, at least two different fire retardant agents and a water-soluble high-valence metal complex;

b. and applying an ink composition onto said fabric print medium to form a printed image.

14. The printing method of claim 13 wherein the ink composition is applied to the fabric print medium via inkjet printing techniques.

15. The printing method of claim 13 wherein the ink composition is an ink composition containing latex components.

* * * * *